US008051572B2

(12) United States Patent
Zhang et al.

(10) Patent No.: US 8,051,572 B2
(45) Date of Patent: Nov. 8, 2011

(54) PLIERS FOR REMOVING FASTENING RING WITH AN ADJUSTING DEVICE

(75) Inventors: Hanzhen Zhang, Tianjin (CN); Lei Zhang, Tianjin (CN)

(73) Assignee: Link-Tech (Tianjin) Metal Products Co., Ltd., Hanjiashu Industrial Park Beichen District, Tianjin (CN)

( * ) Notice: Subject to any disclaimer, the term of this patent is extended or adjusted under 35 U.S.C. 154(b) by 369 days.

(21) Appl. No.: 12/353,270

(22) Filed: Jan. 14, 2009

(65) Prior Publication Data

US 2010/0175516 A1 Jul. 15, 2010

(51) Int. Cl.
*B26B 13/00* (2006.01)

(52) U.S. Cl. ..... 30/252; 30/186; 30/191

(58) Field of Classification Search ..... 30/252, 30/177, 192, 186, 191, 244, 250, 251; 81/385, 81/398, 390, 399, 400
See application file for complete search history.

(56) References Cited

U.S. PATENT DOCUMENTS

| | | | | | |
|---|---|---|---|---|---|
| 2,410,889 | A * | 11/1946 | Martines | 81/314 |
| 2,956,340 | A * | 10/1960 | Levenson | 30/272.1 |
| 3,277,751 | A * | 10/1966 | Filia | 81/313 |
| 3,673,848 | A * | 7/1972 | Filia | 72/409.14 |
| 4,785,536 | A * | 11/1988 | Freyman | 30/124 |
| 6,049,985 | A * | 4/2000 | Gonzalez et al. | 30/233 |
| 6,128,943 | A * | 10/2000 | Lemmens | 72/409.01 |
| 6,250,184 | B1 * | 6/2001 | Chang | 81/415 |
| 6,305,086 | B1 * | 10/2001 | Burgholzer | 30/186 |
| 6,425,183 | B2 * | 7/2002 | Lemmens | 30/186 |
| 6,941,663 | B2 * | 9/2005 | Still | 30/250 |

* cited by examiner

*Primary Examiner* — Boyer D Ashley
*Assistant Examiner* — Omar Flores Sanchez

(57) ABSTRACT

A pair of pliers for removing fastening ring includes a pliers head, a pliers handle and a cover, wherein the pliers head comprises a left pliers head and a right pliers head, the pliers handle comprises a left pliers handle and a right pliers handle, and the left pliers head and the right pliers head are connected to a left pliers handle and a right pliers handle via a connecting shaft respectively, wherein the cover is provided at each of both sides of the pliers head via a head shaft, wherein the cutting edge of the left pliers head is blunt, and a projecting element is extended from an upper portion of the cutting edge of the left pliers head, the cutting edge of the right pliers head is a blade, and an adjusting device is provided at an upper portion of the left pliers handle and the right pliers handle.

8 Claims, 2 Drawing Sheets

PLIERS FOR REMOVING FASTENING RING WITH AN ADJUSTING DEVICE

BACKGROUND OF THE PRESENT INVENTION

1. Field of Invention

The present invention relates to a specialized hardware tool, and more particularly to a pair of pliers for removing a fastening ring used for connecting a plastic pipe and a pipe joint.

2. Description of Related Arts

The traditional way for connecting the PEX pipe or aluminum plastic pipe can be divided into two categories: K series and J series. K series comprises ear type clamps and copper clamp rings. When the pipe line has to be detached or there is a connecting mistake, it is hard to detach the ear type clamp or copper clamp ring from the pipes or pipe joints, so that the whole ear type clamp or copper clamp ring and pipes have to be abandoned together, which causes wastes and increases connecting cost. Now there are specialized pliers available in the market. However this kind of traditional specialized pliers can not adjust the space between the two cutting edges at head of the pliers. Moreover, during the operation, additional tools have to be used for adjusting the position of the head of the pliers, which causes a lot of trouble for the operation, and will affect the working efficiency and product quality.

SUMMARY OF THE PRESENT INVENTION

An object of the present invention is to provide a pair of pliers for removing a fastening ring used for connecting a plastic pipe and a pipe joint, wherein the space between the two cutting edges at head of the pliers can be adjusted.

Another object of the present invention is to provide a pair of pliers for removing a fastening ring used for connecting a plastic pipe and a pipe joint, which is convenient to use and can save connecting cost.

Accordingly, in order to accomplish the above object, the present invention provides a pair of pliers for removing fastening ring comprising a pliers head, a pliers handle and a cover, wherein the pliers head comprises a left pliers head and a right pliers head, the pliers handle comprises a left pliers handle and a right pliers handle, and the left pliers head and the right pliers head are connected to a left pliers handle and a right pliers handle via a connecting shaft respectively, wherein the cover is provided at each of both sides of the pliers head via a head shaft, wherein the cutting edge of the left pliers head is blunt, and a projecting element is extended from an upper portion of the cutting edge of the left pliers head, the cutting edge of the right pliers head is a blade, and an adjusting device is provided at an upper portion of the left pliers handle and the right pliers handle.

The adjusting device comprises an adjusting nut, an adjusting dial, an adjusting screw, a retaining screw and a spring, wherein the adjusting dial is fixed to the middle portion of the left pliers handle by the adjusting nut, a retaining screw is provided above the adjusting dial, and the spring is provided in the retaining screw, an adjusting screw on the right pliers handle is fixed to the adjusting dial of the left pliers handle, and the adjusting screw is against one side of the adjusting dial.

The adjusting dial has an irregular shape with a through hole for receiving the adjusting nut. The side surface is consisting of a large plane, a small plane and an arch. The arch has two grooves thereon, and there is a retainer outside the two grooves.

The advantages of the present invention are illustrated as follows. Due to the projecting element on the pliers head and the adjusting device on the pliers handle, the pliers can retain the pliers head to the fastening ring to avoid the fastening ring to rotate. Compress the pliers handle to remove the fastening ring from the plastic pipe, adjust the adjusting nut to a blocking position corresponding for the size of the plastic pipe, put the blunt cutting edge of the left pliers head in the plastic pipe so that the fastening ring is removed by the blade of the right pliers and can be taken off from the pipe. The process of removing the fastening ring will not damage the pipe. The present invention is low cost, can save resources and is convenient to use.

These and other objectives, features, and advantages of the present invention will become apparent from the following detailed description, the accompanying drawings, and the appended claims.

DETAILED DESCRIPTION OF THE PREFERRED EMBODIMENT

Figure 1:
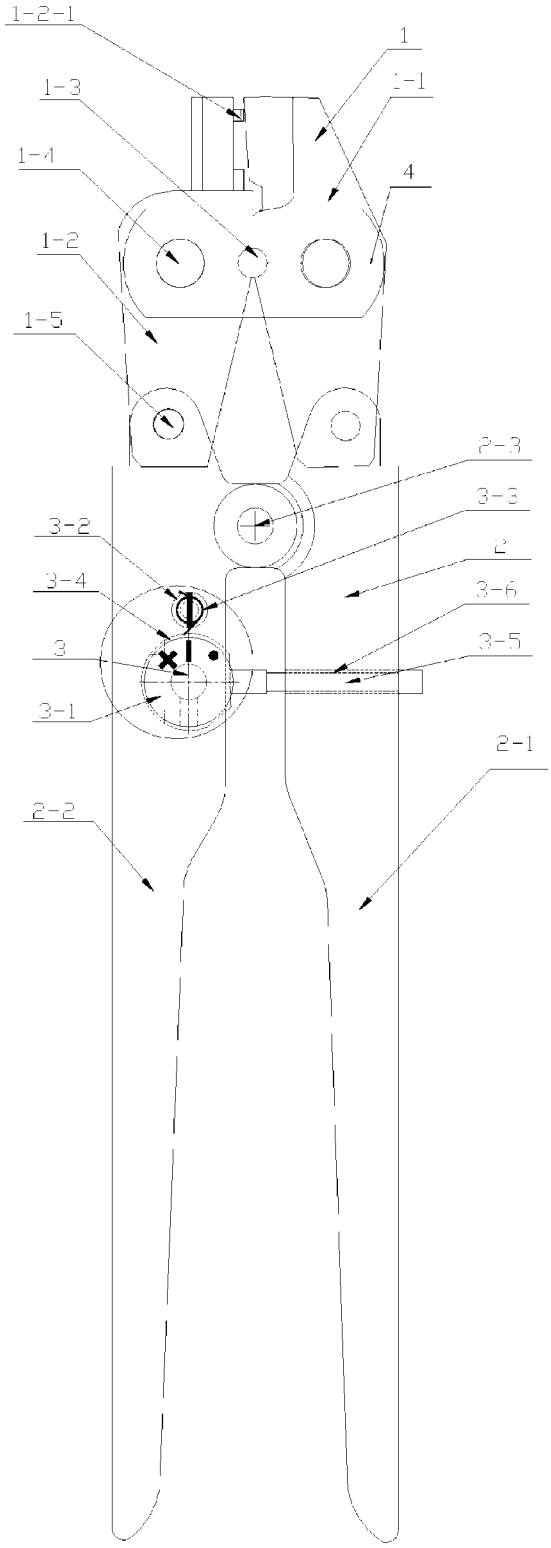
FIG. 1 is a perspective view of a pair of pliers according to a preferred embodiment of the present invention.
Figure 2:
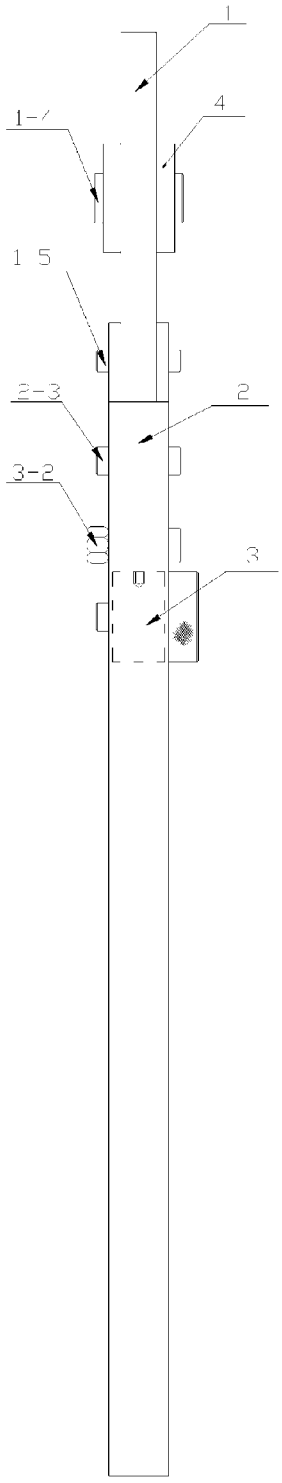
FIG. 2 is a left side view of FIG. 1.
Figure 3:
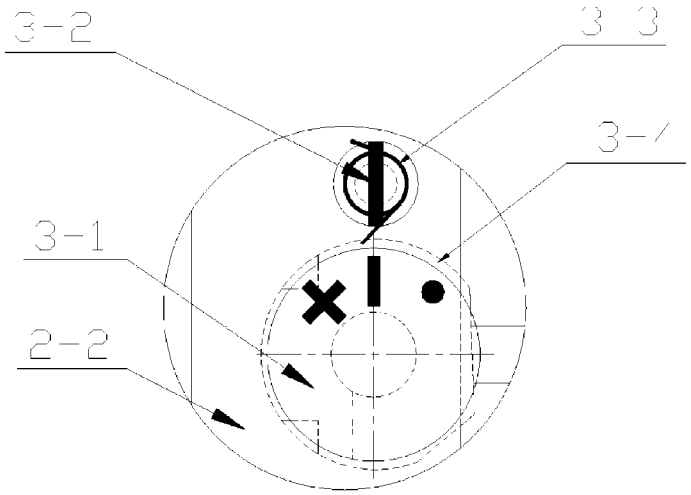
FIG. 3 is a partially enlarged view of FIG. 1.
Figure 4:
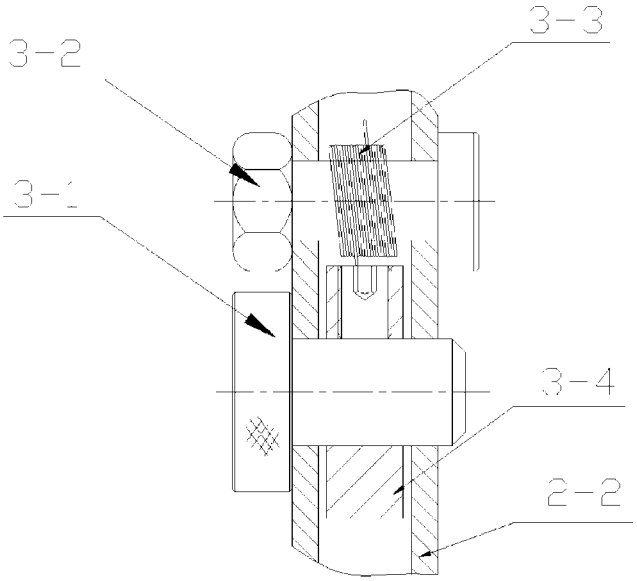
FIG. 4 is a sectional view of FIG. 3.

Referring to FIG. 1 through FIG. 4 of the drawings, a pair of pliers for removing fastening ring according to a preferred embodiment of the present invention is illustrated, in which the pliers comprises a pliers head 1, a pliers handle and a cover 4. The pliers head comprises a left pliers head 1-2 and a right pliers head 1-1. A positioning pin 1-3 is provided at the connecting point of the left pliers head 1-2 and the right pliers head 1-1. The left pliers head 1-2 and the right pliers head 1-1 are connected to a left pliers handle 2-2 and a right pliers handle 2-1 via a connecting shaft 1-5 respectively. The left pliers handle 2-2 and the right pliers handle 2-1 are connected via a handle shaft 2-3 and can rotate around the handle shaft 2-3. A cover 4 is provided at each of both sides of the pliers head 1 via a head shaft 1-4. The cutting edge of the left pliers head 1-2 is blunt, and a projecting element 1-2-1 is extended from an upper portion of the cutting edge of the left pliers head 1-2 for retaining the pliers head to the fastening ring and avoiding the fastening ring to rotate. The cutting edge of the right pliers head 1-2 is a blade for removing the fastening ring. An adjusting device 3 is provided at an upper portion of the left pliers handle and the right pliers handle. The adjusting device 3 comprises an adjusting nut 3-1, an adjusting dial 3-4, an adjusting screw 3-5, a retaining screw 3-2 and a spring 3-3. The adjusting dial 3-4 is fixed to the middle portion of the left pliers handle 2-2 by the adjusting nut 3-1. The adjusting dial 3-4 has an irregular shape with a through hole for receiving the adjusting nut 3-1. The side surface is consisting of a large plane, a small plane and an arch. The arch has two grooves thereon, and there is a retainer outside the two grooves for avoiding the adjusting nut to move during the adjusting process of the adjusting nut. A retaining screw 3-2 is provided above the adjusting dial, and the spring 3-3 is provided in the retaining screw. An adjusting screw 3-5 on the right pliers handle is fixed to the adjusting dial of the left pliers handle, wherein the adjusting screw 3-5 is against one side of the adjusting dial. An adjusting screw cover 3-6 covers the adjusting screw. The adjusting dial 3-4 has three blocking positions, which are the large plane blocking position, a small plane blocking position and an arch blocking position. The large plane blocking position is for removing the single ear type clamp, a small plane blocking position is for removing small metal clamp ring and cutting plastic pipe, and an arch blocking position is for removing large metal clamp ring and cutting plastic pipe. The blocking positions can be adjusted according to the actual need to adjust the opening size of the head of the pliers so as to remove the metal clamp ring and cut plastic pipe.

The operating process of the present invention is illustrated as follows. Firstly, retain the fastening ring by the projecting element 1-2-1 of the left pliers head, compress the pliers handle to remove the fastening ring from the plastic pipe, adjust the adjusting nut to a blocking position corresponding for the size of the plastic pipe, put the blunt cutting edge of the left pliers head in the plastic pipe so that the plastic pipe is removed by the blade of the right pliers, at the same time, rotate the adjusting nut 3-1 on the left pliers handle to rotate the adjusting dial 3-4 to push the tail of the spring 3-3 into the corresponding groove, until the adjusting screw is against the adjusting dial after the two pliers handles close.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pair of pliers for removing a fastening ring, comprising:

a pliers head comprising a left pliers head and a right pliers head, wherein a cutting edge of said left pliers head is blunt, and a cutting edge of said right pliers head is a blade, wherein a projecting element is extended from an upper portion of said cutting edge of said left pliers head;

a pliers handle comprising a left pliers handle and a right pliers handle, wherein said left pliers head and said right pliers head are rotatablely connected to said left pliers handle and said right pliers handle respectively;

an adjusting device provided at an upper portion of said left pliers handle and said right pliers handle, comprising:

an adjusting nut;

an adjusting dial fixed to a middle portion of said left pliers handle by said adjusting nut, wherein said adjusting dial has an irregular shape with a through hole for receiving said adjusting nut, and a side surface consisting of a first plane, a second plane and an arch, wherein said arch has two grooves thereon, and there is a retainer outside said two grooves;

an adjusting screw provided on said right pliers handle, wherein said adjusting screw on said right pliers handle is fixed to said adjusting dial of said left pliers handle, and said adjusting screw is against one side of said adjusting dial;

a retaining screw provided above said adjusting dial; and a spring provided in said retaining screw; and a cover provided at each of both sides of said pliers head via a head shaft.

2. The pair of pliers, as recited in claim 1, wherein said pair of pliers is adapted for ear type clamps or copper clamp rings.

3. The pair of pliers, as recited in claim 1, wherein said adjusting dial has a first plane blocking position for removing single ear type clamps, a second plane blocking position for removing small metal clamp rings and cutting plastic pipes, and an arch blocking position for removing large metal clamp rings and cutting plastic pipes, wherein said first plane, second plane and arch blocking positions can be adjusted according to an actual need to adjust an opening size of said head of said pliers so as to remove metal clamp rings and cut plastic pipes.

4. The pair of pliers, as recited in claim 2, wherein said adjusting dial has a first plane blocking position for removing single ear type clamps, a second plane blocking position for removing small metal clamp rings and cutting plastic pipes, and an arch blocking position for removing large metal clamp rings and cutting plastic pipes, wherein said first plane, second plane and arch blocking positions can be adjusted according to an actual need to adjust an opening size of said head of said pliers so as to remove metal clamp rings and cut plastic pipes.

5. The pair of pliers, as recited in claim 1, wherein said adjusting device further comprises an adjusting screw cover covering said adjusting screw.

6. The pair of pliers, as recited in claim 2, wherein said adjusting device further comprises an adjusting screw cover covering said adjusting screw.

7. The pair of pliers, as recited in claim 3, wherein said adjusting device further comprises an adjusting screw cover covering said adjusting screw.

8. The pair of pliers, as recited in claim 4, wherein said adjusting device further comprises an adjusting screw cover covering said adjusting screw.

* * * * *